US005493280A

United States Patent [19]

Shibayama

[11] Patent Number: 5,493,280

[45] Date of Patent: Feb. 20, 1996

[54] RADIO PAGING RECEIVER

[75] Inventor: Hiroaki Shibayama, Tokyo, Japan

[73] Assignee: NEC Corporation, Tokyo, Japan

[21] Appl. No.: 139,715

[22] Filed: Oct. 22, 1993

[30] Foreign Application Priority Data

Oct. 23, 1992 [JP] Japan ..... 4-285665

[51] Int. Cl.[6] ..... G08B 5/22

[52] U.S. Cl. ..... 340/825.44; 340/825.3; 345/207

[58] Field of Search ..... 340/825.44, 311.1, 340/825.3; 345/48, 50, 207

[56] References Cited

U.S. PATENT DOCUMENTS

| | | | |
|---|---|---|---|
| 3,742,481 | 6/1973 | Nickerson | 340/311 |
| 4,754,275 | 6/1988 | Abbaticchio et al. | 340/825.44 |
| 4,868,563 | 9/1989 | Stair et al. | 340/825.44 |
| 5,077,551 | 12/1991 | Saitou | 345/207 |
| 5,239,295 | 8/1993 | Deluca et al. | 340/825.44 |
| 5,321,963 | 6/1994 | Goldman | 340/825.31 |

FOREIGN PATENT DOCUMENTS

| | | |
|---|---|---|
| 0135928 | 4/1985 | European Pat. Off. . |
| 0168821 | 1/1986 | European Pat. Off. . |
| 2199435 | 7/1988 | United Kingdom . |

*Primary Examiner*—Donald J. Yusko
*Assistant Examiner*—Gregg V. Miller
*Attorney, Agent, or Firm*—Sughrue, Mion, Zinn, Macpeak & Seas

[57] ABSTRACT

A radio paging receiver enables an user of the receiver later to see a received message even when an alert stopping operation or message confirmation operation is first executed in an environment too dark to see the received message. The receiver has a photosensor for detecting whether a display environment is light or dark. If the alert stopping operation is executed in the dark condition, the received message is stored in a memory as an unconfirmed message, so that the user later can see and read the received message in a light condition after a change of the environment. In addition, when the environment is changed from a dark condition to a light condition, if an unconfirmed message exists in the memory, the receiver alerts the user.

12 Claims, 3 Drawing Sheets

RADIO PAGING RECEIVER

BACKGROUND OF THE INVENTION

1. Field of the Invention

The present invention relates to a radio paging receiver capable of reliably informing the user of a message having not been confirmed.

2. Description of the Related Art

In the prior art radio paging receiver, when the receiver is paged by the base station, the receiver informs the user of this paging by an alert (e.g., an alert sound) and displays the received massage. When the user carries out a operation for confirmation of the displayed message (e.g., pressing an alert reset switch), the alert stops. Therefore, if the user performs the confirmation operation in a dark environment to see a message, the message is determined to have been confirmed even though the user has not actually read the displayed message.

In addition, recently, there are many types of radio paging receiver. Especially, in the case of a paging receiver having a case or a cover which covers a display, if the user carries out the above-mentioned confirmation operation of a displayed message without opening such a case or cover when the paging receiver is paged, the displayed message is processed as a confirmed message even if the user cannot see the displayed message.

On the other hand, it is a common practice with another prior art paging receiver to inform the user, upon the pressing of a switch, of the existence of unconfirmed messages. Namely, the prior art paging receiver does not allow the user to know the existence of such an unconfirmed message unless the user presses the switch. Therefore, in the case where the paging receiver lacks illumination for display, when the user operates the paging receiver to see the unconfirmed messages, all the existing message are dealt with as confirmed messages even when the environment is too dark to see a message.

SUMMARY OF THE INVENTION

It is therefore an object of the present invention to eliminate the above problems and provide a radio paging receiver which does not dispose of a message which could not be confirmed due to a dark environment.

Another object of the present invention is to provide a radio paging receiver which allows the user to be informed of the existence of an unconfirmed message, without pressing a switch, when the environment of the receiver changes from a dark condition to a light condition.

According to the present invention, the inventive radio paging receiver comprises:

a receiving section for receiving a radio signal containing a message signal;

photosensor means for detecting whether a message display environment is light or dark;

alert control means for generating an alert signal when the receiver is paged by received radio signal;

alerting means responsive to the alert signal for alerting an user of the receiver;

alert stopping means for stopping an alert signal generated by the alerting means when an alert stopping operation is executed by the user during the alert; and message storing means for storing, if the photosensor means detects a dark condition when the alert stopping operation is executed, the received message in a memory as an unconfirmed message having not been confirmed by the user.

BRIEF DESCRIPTION OF THE DRAWINGS

The above objects and features of this invention will become more apparent from the following detailed description when taken in conjunction with the attached drawings.

In the drawings, the same reference numerals denote the same structural elements.

DESCRIPTION OF THE PREFERRED EMBODIMENT

Figure 1:
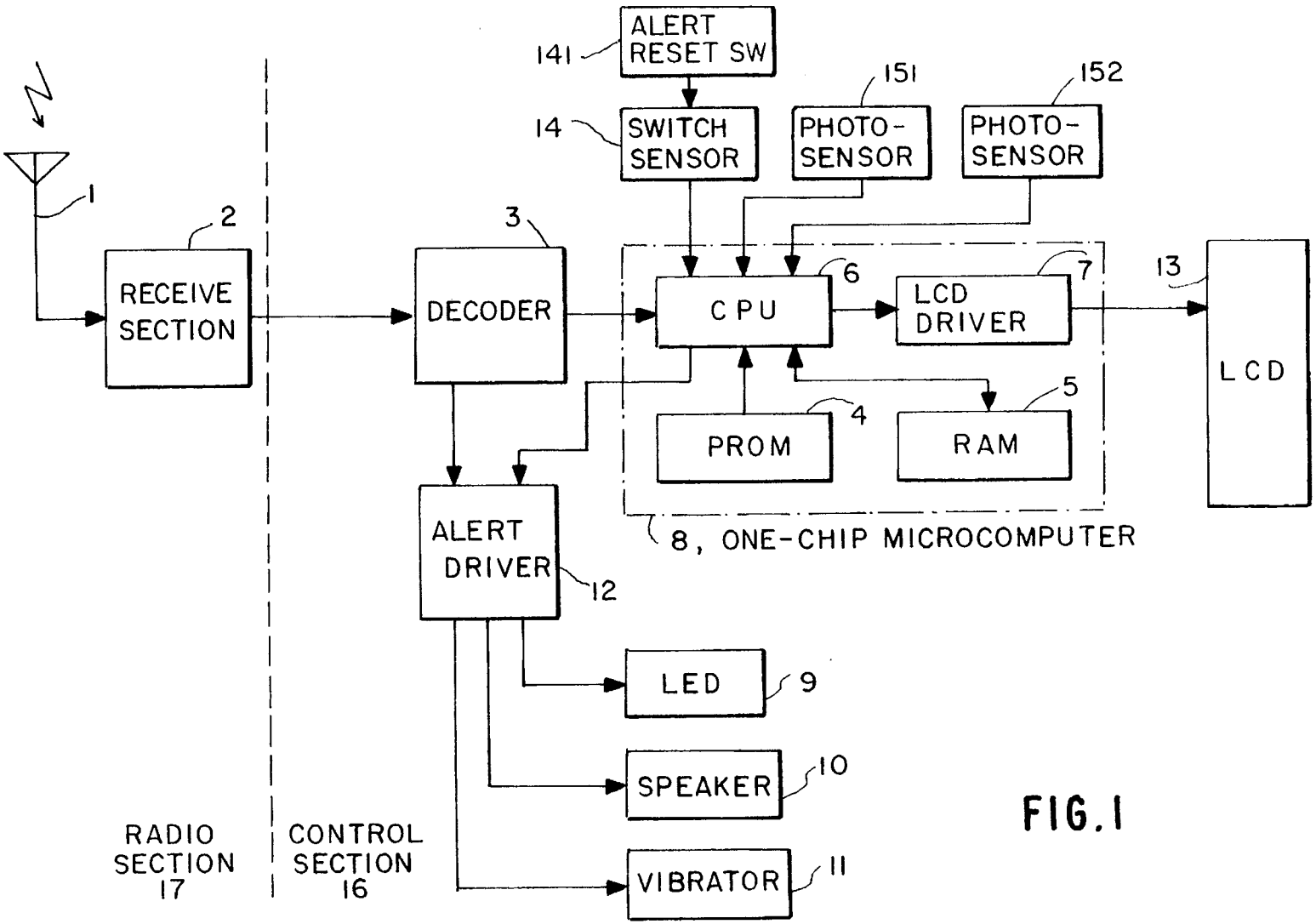
FIG. 1 is a block diagram of an embodiment of the receiver of the present invention.

Referring to FIG. 1, an embodiment of the present invention has a radio section 17 separated from the rest of the circuitry by a dotted line, and a control section 16 for controlling the receiving operation upon receiving the output of the radio section 17.

The radio section 17 has an antenna 1 for receiving a radio wave, and a receive section 2 for demodulating the received signal.

The control section 16 has a decoder 3 for decoding the demodulated signal, a 1-chip microcomputer 8 for controlling the entire operation of the paging receiver, a switch sensor 14 having an alert reset switch 141 for interrupting a CPU built into the 1-chip microcomputer and having a power source switch (not shown) for turning on a power source, a photosensor 151 for determining whether the message display environment is light or dark, a photosensor 152 for determining whether the environment of the receiver is light or dark, an alert driver 12, an LED (Light Emitting Diode) 9, a speaker 10, a vibrator 11 driven a motor to vibrate, and an LCD (Liquid Crystal Display) 13 for displaying a message.

The 1-chip microcomputer 8 has a PROM 4 storing a program and used to select an optional function, a RAM 5 for storing received messages, a CPU 6, and an LCD driver 7 for driving the LCD 13.

The LED 9, the speaker 10, and the vibrator 11 are driven by the alert driver 12 for informing the user of the reception of a message according to the selection of the user.

Figure 2:
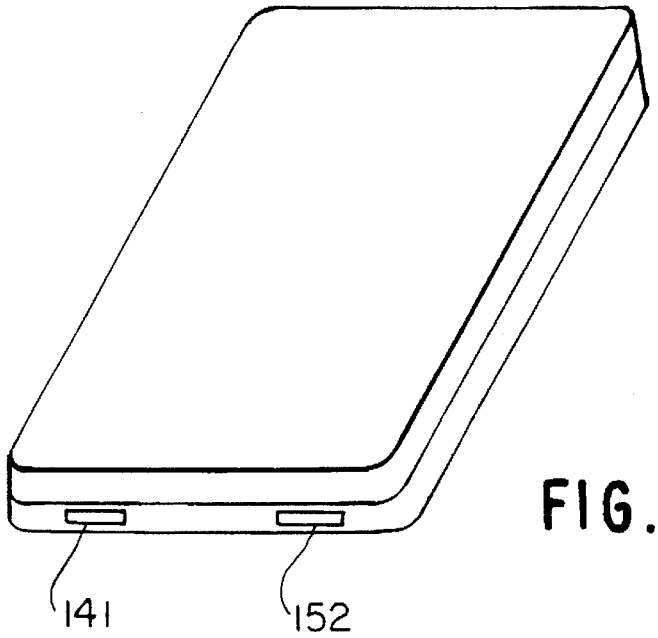
FIG. 2 is a perspective view of the embodiment and showing the state in which the lid of the receiver is closed.
Figure 3:
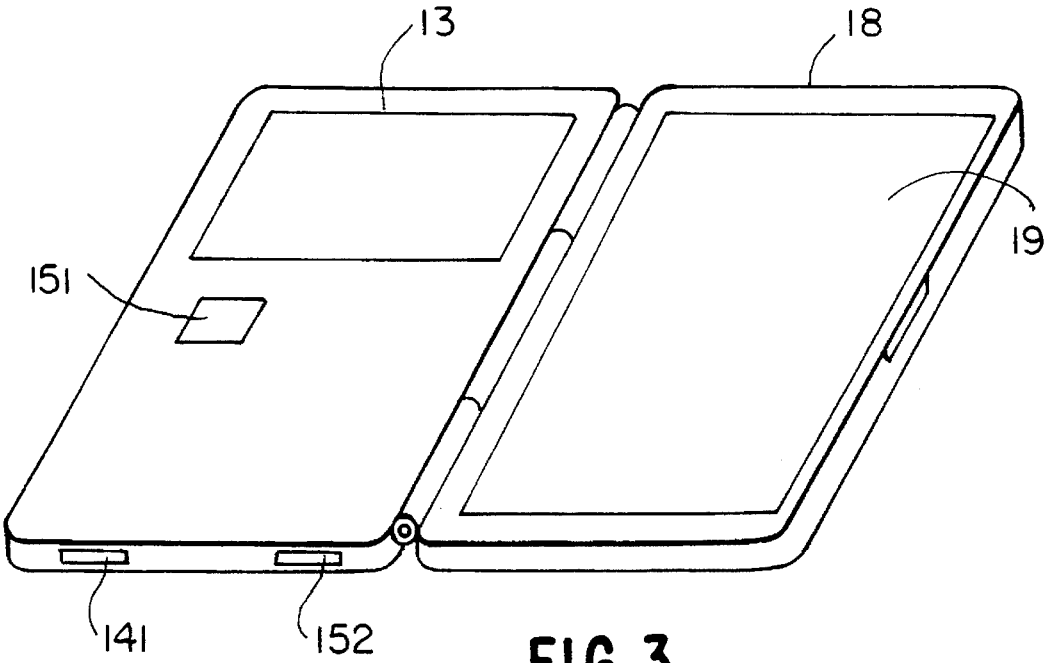
FIG. 3 is a perspective view of the embodiment and showing the state in which the lid of the receiver is opened.

The physical structure of this embodiment is shown in FIGS. 2 and 3. In this embodiment a radio paging receiver is built into an electronic pocketbook having other functions, for example, a calculating function, a scheduler function, and a telephone number memory function. The pocketbook type paging receiver also has a lid 18 and a keyboard 19.

The photosensor 151 is provided for detecting whether the lid 18 is closed (FIG. 2) or opened (FIG. 3). Namely, if the photosensor 151 detects alight condition, the CPU 6 recognizes that the lid 18 is opened. When the lid 18 is closed, the user cannot see the display 13 and, of course, cannot read the displayed message.

The photosensor 152 is provided for detecting a change of environment condition of the receiver. Namely, when the environment is changed from a dark condition, in which the user cannot read a displayed message, to a light condition in which the user can read the message, the CPU 6 detects the change by the photosensor 152.

Figure 4:
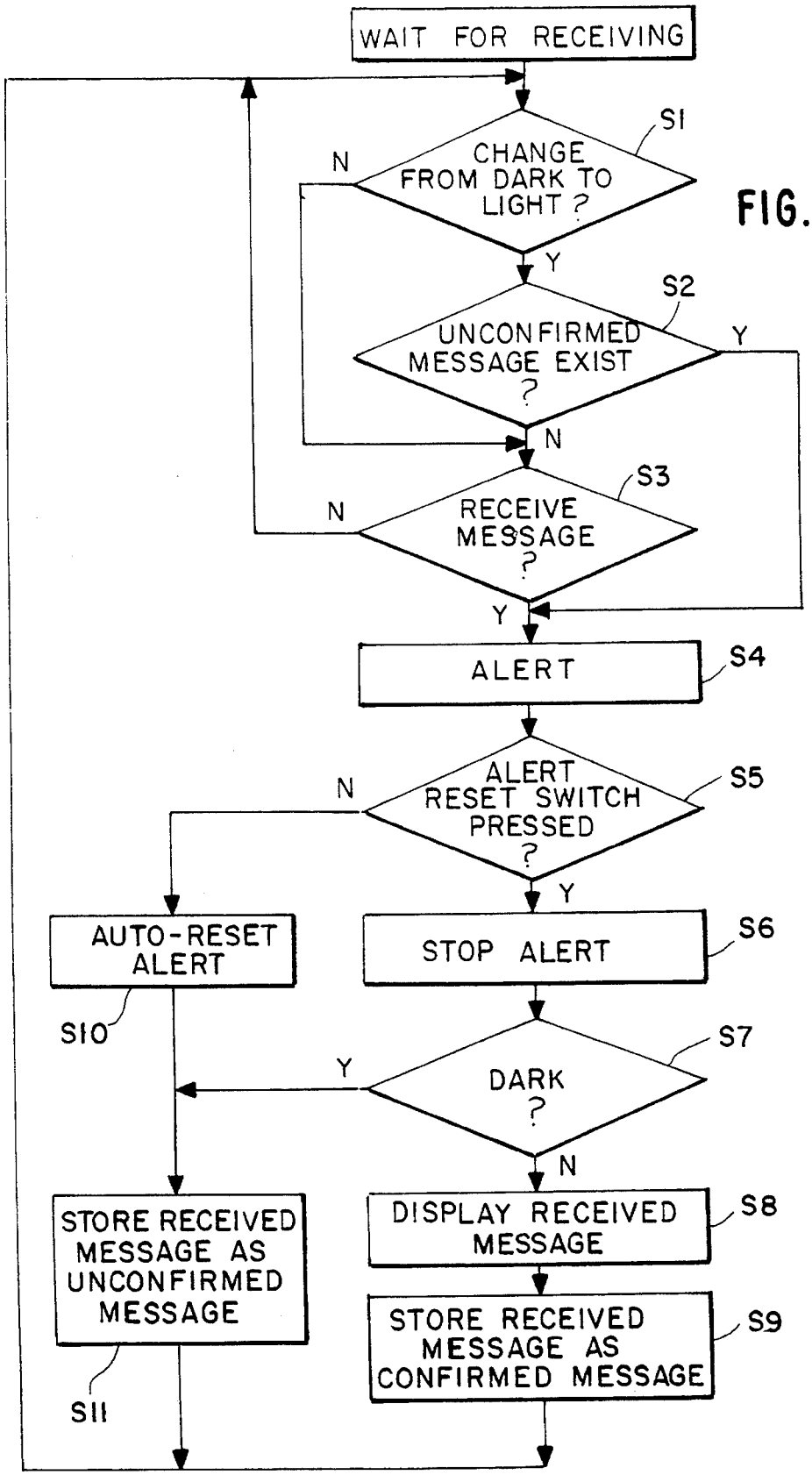
FIG. 4 is a flowchart showing the operation of the embodiment.

Next, reference will be also be made to FIG. 4 for describing the operation of the embodiment.

The user carrying the paging receiver turns on the power source by operating the power switch implemented by the switch sensor 14. Then the paging receiver shifts into a waiting state for receiving radio signal.

Upon detection by the photosensor 152 of a change from a dark condition to a light condition (step S1), and if an unconfirmed message exists (step S2), the CPU 6 outputs an alert signal to the alert driver 12. In response to the alert signal, the alert driver 12 drives at least one of an alerting device, i.e., the LED 9, the speaker 10 and the vibrator 11 for informing the user of the existence of an unconfirmed message (step S4) which now can be read because the display environment is in the light condition. The user stops the alert by pressing the alert reset switch 141 and carries out the reading operation for reading out the unconfirmed message from the RAM 5. Namely, the user opens the lid 18 and operates the keyboard 19 to display the unconfirmed message.

On the other side, an FSK (Frequency Shift Keying) modulated wave coming in through the antenna 1 is received and demodulated by the receiving section 2, decoded by the decoder 3 and then applied to the 1-chip microcomputer 8 and alert driver 12 (step S3).

As the decoder 3 determines that the received call is meant for the paging receiver, the 1-chip microcomputer 8 executes an alerting procedure by determining that a call meant for the paging receiver has been received (step S4). Namely, when the decoder 3 detects that an address included in the received call is coincident with an address stored in the decoder 3, the received call is processed as a call meant for the receiver. Then, a received message following the received address is processed by the CPU 6. When the CPU 6 is interrupted by the alert reset switch 141 during the alerting procedure (step S5), the alert stops (step S6).

Next, the CPU 6 determines by the photosensor 151 whether the message display environment is light or dark (step S7). If the environment is dark in step S7, the received message is stored in the RAM 5 under the control of the CPU 6 as an unconfirmed message having not been confirmed (step S11).

If the environment is light in step S7, a procedure for reading out the receiving message is executed and the received message is displayed (step S8).

After the received message has been read out, it is stored in the RAM 5 as a confirmed message (step S9). Thereafter, the program returns to the message waiting state.

If the CPU 6 is not interrupted during the alerting procedure (the alerting is continued for a predetermined time period) in step S5, the CPU 6 automatically ends the alerting procedure (step S10), stores the received message as an unconfirmed message (step S11), and then awaits another message.

Although the present invention has been fully described by way of a preferred embodiment thereof with reference to the accompanying drawings, various changes and modifications will be apparent to those having skill in this field. Therefore, unless these changes and modifications otherwise depart from the scope of the present invention, they should be construed as included therein.

What is claimed is:

1. A radio paging receiver comprising:

receiving means for receiving a radio signal containing a message signal;

first light/dark detecting means for detecting whether a message display environment is light or dark;

alert control means for generating an alert signal when the receiver is paged by a received radio signal;

alerting means, responsive to the alert signal, for generating an alert for a user of the receiver;

alert stopping means for stopping an alert generated by the alerting means, when an alert stopping operation is executed by the user during the alert; and message storing means for storing, if said light/dark detecting means detects a dark condition when the alert stopping operation executed, the received message in a memory as an unconfirmed message having not been confirmed by the user.

2. The radio paging receiver as claimed in claim 1, wherein said first light/dark detecting means comprises a photosensor.

3. The radio paging receiver as claimed in claim 2, further comprising a lid for covering the photosensor and a display.

4. The radio paging receiver as claimed in claim 3, further comprising second light/dark detecting means for detecting whether a environment of the receiver is light or dark.

5. The radio paging receiver as claimed in claim 4, wherein said alerting means generates the alert when said second light/dark detecting means detects a change of the environment from the dark condition to a light condition, if the unconfirmed message is stored in the memory.

6. The radio paging receiver as claimed in claim 5, wherein said second light/dark detecting means comprises a photosensor which is not covered by said lid.

7. A radio paging receiver comprising:

alerting means for reporting the presence of a received message;

message distinguishing means for determining whether a received message has been confirmed by an operation of an user of the receiver;

light/dark detecting means for determining whether a message display environment is light or dark; and message storing means for storing, if said light/dark detecting means detects a dark condition when the operation for confirming the received message is executed, the received message in a memory as an unconfirmed message having not been confirmed.

8. The radio paging receiver as claimed in claim 7, wherein said alerting means executes an alert operation when said light/dark detecting means detects a change of the environment from the dark condition to a light condition, if the unconfirmed message is stored in the memory.

9. A method for controlling a radio paging receiver, the method comprising the steps of:

(a) receiving a message to be displayed at the receiver;

(b) alerting an user of the receiver of said receiving;

(c) detecting an operation for stopping said alerting;

(d) detecting whether a message display environment is light or dark at the time of execution of step (c);

(e) displaying the received message if a light condition is detected in step (d); and (f) storing the received message as an unconfirmed message in a memory if a dark condition is detected in step (d).

10. The method for controlling a radio paging receiver as claimed in claim 9, the method further comprising:

(g) detecting whether a environment of the receiver is light or dark;

(h) detecting a change in the environment in step (g) from a dark condition to a light condition; and (i) alerting the user if said change is detected in step (h) when the unconfirmed message exists in the memory.

11. A radio paging receiver comprising:

light/dark detecting means for detecting whether a message display environment is light or dark; and generating means for generating a signal when the light/dark detecting means detects a change from a dark display environment to a light display environment and a message unconfirmed by a user has been stored in a memory.

12. The radio paging receiver as claimed in claim 11, further comprising alerting means, responsive to the signal, for generating an alert for the user.

* * * * *